US008522549B2

(12) United States Patent
Sumser et al.

(10) Patent No.: US 8,522,549 B2
(45) Date of Patent: Sep. 3, 2013

(54) RADIAL COMPRESSOR, PARTICULARLY FOR AN EXHAUST GAS TURBOCHARGER OF AN INTERNAL COMBUSTION ENGINE

(75) Inventors: Siegfried Sumser, Stuttgart (DE); Stephan Krätschmer, Schwäbisch Gmünd (DE); Michael Stiller, Schwaikheim (DE)

(73) Assignee: Daimler AG, Stuttgart (DE)

( * ) Notice: Subject to any disclaimer, the term of this patent is extended or adjusted under 35 U.S.C. 154(b) by 325 days.

(21) Appl. No.: 12/927,869

(22) Filed: Nov. 27, 2010

(65) Prior Publication Data

US 2011/0088392 A1 Apr. 21, 2011

Related U.S. Application Data

(63) Continuation-in-part of application No. PCT/EP2009/006387, filed on Sep. 3, 2009.

(30) Foreign Application Priority Data

Sep. 17, 2008 (DE) ..... 10 2008 047 506

(51) Int. Cl.
*F01D 1/12* (2006.01)
*F04D 29/44* (2006.01)
*F02B 33/44* (2006.01)

(52) U.S. Cl.
USPC ..... 60/605.1; 415/58.4; 415/205

(58) Field of Classification Search
USPC ..... 60/605.1; 415/58.4, 205, 206
See application file for complete search history.

(56) References Cited

U.S. PATENT DOCUMENTS

| | | | | |
|---|---|---|---|---|
| 5,868,552 | A * | 2/1999 | McKean et al. | 415/158 |
| 7,083,379 | B2 * | 8/2006 | Nikpour et al. | 415/56.5 |
| 2002/0071765 | A1 * | 6/2002 | Sahay et al. | 415/206 |
| 2007/0271921 | A1 | 11/2007 | Chen | |
| 2008/0292449 | A1 * | 11/2008 | Lefevre | 415/58.4 |

FOREIGN PATENT DOCUMENTS

| | | | |
|---|---|---|---|
| EP | 0 229 519 | | 7/1987 |
| GB | 2 220 447 | | 1/1990 |
| WO | WO 2005068842 | A1 * | 7/2005 |
| WO | WO 2006/093878 | | 9/2006 |
| WO | WO 2007093367 | A1 * | 8/2007 |
| WO | WO 2008149060 | A2 * | 12/2008 |

OTHER PUBLICATIONS

Machine Translation of WO 2007/093367 A1 (see attached).*
Machine Translation of WO 2007/093367 A1 (original foreign language document published in Aug. 2007; a translation already provided in First Office Action on the Merits).*

* cited by examiner

*Primary Examiner* — Thomas Denion
*Assistant Examiner* — Ngoc T Nguyen
(74) *Attorney, Agent, or Firm* — Klaus J. Bach

(57) ABSTRACT

In a radial compressor, particularly of an exhaust gas turbocharger of an internal combustion engine, having a compressor housing within which a compressor wheel is disposed for compressing air from an inflow channel of the compressor housing and directing the air to an outflow channel of the compressor housing, the compressor housing comprising a bypass channel having a first flow opening upstream of an axial compressor wheel inlet and a second flow opening downstream of the compressor wheel inlet, the compressor housing is configured at least in a flow region upstream of the second flow opening in an asymmetric manner with regard to a rotational axis of the compressor wheel.

9 Claims, 1 Drawing Sheet

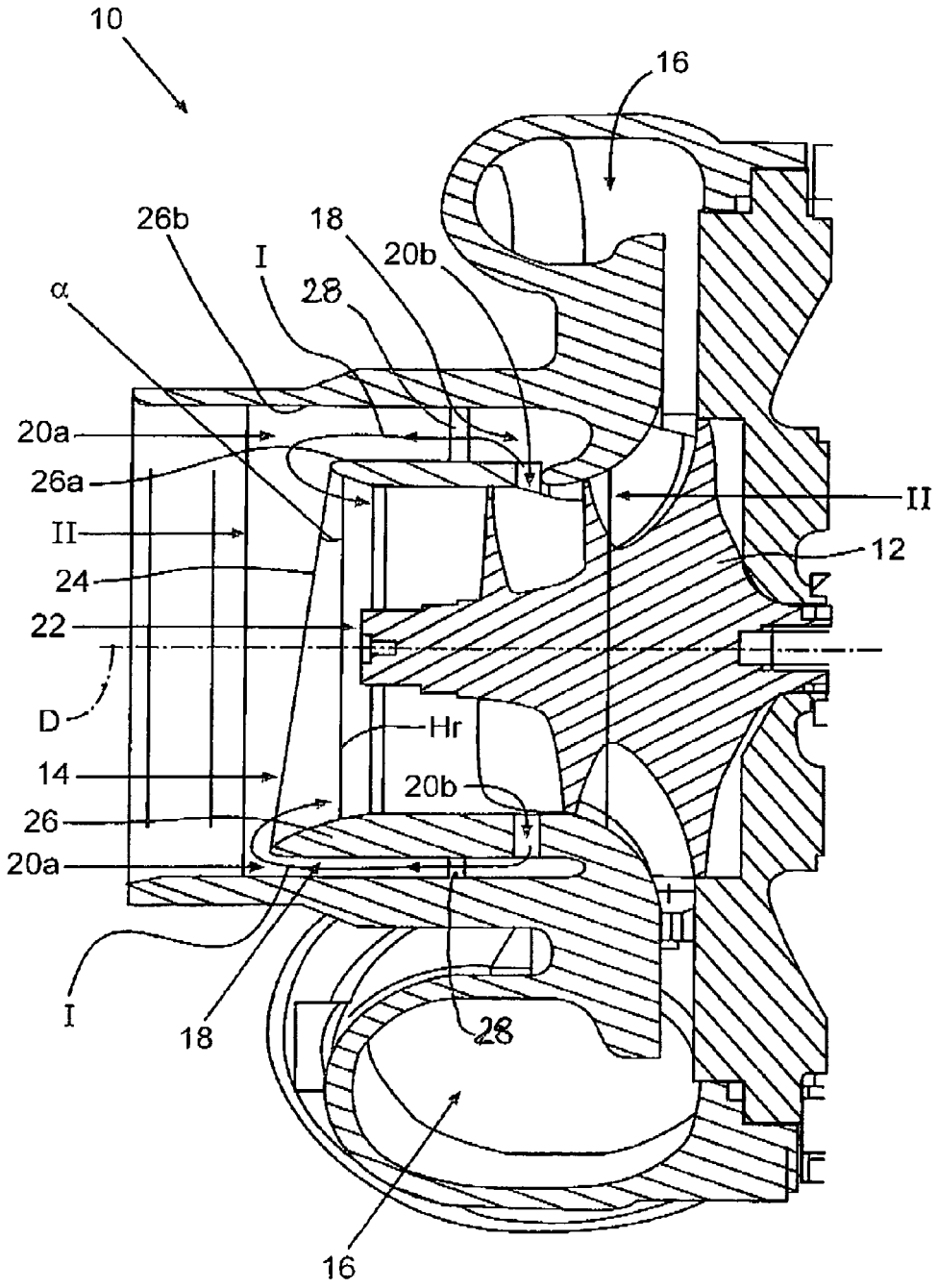
10
16
26b
18
20b
I
28
α
20a
26a
II
II
12
24
22
D
Hr
14
20b
26
20a
I
18
28
16

RADIAL COMPRESSOR, PARTICULARLY FOR AN EXHAUST GAS TURBOCHARGER OF AN INTERNAL COMBUSTION ENGINE

This is a Continuation-In-Part Application of pending international patent application PCT/EP2009/006387 filed Sep. 3, 2009 and claiming the priority of German patent application 10 2008 047 506.8 filed Sep. 17, 2008.

BACKGROUND OF THE INVENTION

The invention relates to a radial compressor, particularly for an exhaust gas turbocharger of an internal combustion engine and also to a motor vehicle with an internal combustion engine and a turbocharger having a radial compressor arranged in an intake section of the internal combustion engine.

The development of charged internal combustion engines for utility or passenger motor vehicles with a desired torque behavior require increasingly broadened compressor characteristic fields. The compressor characteristic field, in which the relation of the starting pressure to the input pressure of the compressor is plotted with regard to the mass flow rate, is limited on the one side by the so-called surge line of the compressor, that is, the minimum possible volume flow, and on the other side by the so-called choke line of the compressor, that is, the maximum possible volume flow. In the region between the surge and the choke line, a stable operation of the compressor and thus of the associated internal combustion engine is possible. With a given nominal point and a corresponding nominal flow rate, the surge line position is also determined by radial compressors in a decisive manner. The torque line with maximum torques of the associated internal combustion engines is thus determined up to the average engine speeds by the surge line of the radial compressor. On the left of the surge line, with smaller mass flow rates, a stable operation of the radial compressor and of the internal combustion engine is no longer ensured due to pump surges. In addition, there is the danger that during an operation below the surge line the radial compressor is damaged already after a relatively short running time. By means of the development of performance graph stabilizing measures (KSM), it is attempted to displace the surge line to low mass flow rates, in order to be able to increase the start-up torque, the acceleration torque and the maximum torque of the associated internal combustion engine.

To this end, radial compressors are known in the state of the art which have a compressor wheel arranged within a compressor housing. The compressor wheel serves for compressing air which is conducted to the compressor wheel via an inflow channel of the compressor housing. The compressed air can subsequently be directed by the compressor wheel into an outflow channel of the compressor housing. The compressor housing additionally comprises a bypass channel as a performance graph measure, which bypass channel has at least a first flow opening upstream of an axial compressor wheel inlet and a second flow opening downstream of the compressor wheel inlet. In an operating region near the surge line, it is hereby possible to discharge the air via the compressor wheel into the bypass channel through the second flow opening and to guide it back to the first compressor wheel inlet after conducting it out of the first flow opening. The mass flow entering the compressor wheel is thereby increased in an advantageous manner. In operating regions near the choke line the flow direction is opposed to the compressor inflow direction. The inflow to the compressor wheel thus takes place on the one hand through the inflow channel and on the other hands via the bypass channel in that air enters the bypass channel through the first flow opening and is supplied to the compressor wheel through the second flow opening. The narrowest cross section of the compressor wheel is hereby partially bypassed in the region of its compressor wheel inlet, so that a higher air mass can be passed through the compressor. It can alternatively be provided that the second flow opening of the bypass channel discharges into the outflow channel downstream of a compressor wheel outflow.

The possiblity that flow swirls and flow displacements form during an operation near the surge line in the region of the rotating compressor wheel is thereby seen to be disadvantageous with the known radial compressors, as this leads to corresponding efficiency losses and instabilities in the compressor operation.

It is thus the object of the present invention to provide a radial compressor of the above-mentioned type which enables a decrease of the surge line and an improved adaptability to the requirements of different types of internal combustion engines in a constructively simple manner.

SUMMARY OF THE INVENTION

In a radial compressor, particularly of an exhaust gas turbocharger of an internal combustion engine, having a compressor housing within which a compressor wheel is disposed for compressing air from an inflow channel of the compressor housing and directing the air to an outflow channel of the compressor housing, the compressor housing comprising a bypass channel having a first flow opening upstream of an axial compressor wheel inlet and a second flow opening downstream of the compressor wheel inlet, the compressor housing is configured at least in a flow region upstream of the outflow channel so as to be asymmetric manner with regard to a rotational axis of the compressor wheel.

In other words, it is provided that the compressor housing has, in contrast to the state of the art, a geometry deviating from the symmetry with respect to the compressor axis in its regions upstream of the usually spirally and thus asymmetrically formed outlet channel. Hereby, a defined flow irregularity and a correspondingly asymmetric inflow and outflow of the compressor wheel can be provided, whereby, surprisingly, a significant stabilization of the rotational flow discontinuity is achieved in the different flow channels of the compressor housing and the pumping tendency of the compressor wheel is displaced to significantly lower mass flow rates. Due to this constructively simple measure, an improved and in particular cost-efficient adaptability of the radial compressor to requirement profiles of different types of internal combustion engines is additionally obtained.

In an advantageous embodiment of the invention it is provided that the bypass channel and/or the inflow channel and/or the first flow opening and/or the second flow opening is formed in an asymmetric manner with regard to the rotational axis of the compressor wheel. In that at least one of the mentioned channels or one of the flow openings has the rotational asymmetry according to the invention, a defined and individually adjustable adaptability of the compressor characteristic field of the radial compressor to different types of internal combustion engines and requirement profiles is given.

Further advantages result in that a radial inner and/or a radial outer channel wall of the bypass channel is formed in an asymmetric manner with regard to the rotational axis. This also enables in addition to the advantageous lowering of the surge line a defined increase of the choke line of the radial compressor.

In a further arrangement it has been shown to be advantageous if the radial inner and/or the radial outer channel wall of the bypass channel is formed circular and/or elliptical in its cross section at least over a longitudinal region. In other words, the respective channel wall of the bypass channel can be formed as a cylinder casing surface and/or elliptical casing surface at least in regions, wherein at least in the case of a channel wall formed as a cylinder casing surface, a center axis of the cylinder is arranged non-coaxially to the rotational axis of the compressor wheel. This represents a constructively simple and cost-efficient possibility for the defined influencing and broadening of the characteristic field.

A further advantageous possibility for the defined influencing of the flow behavior and thus the compressor performance graph of the radial compressor is given in a further arrangement in that the bypass channel and/or the inflow channel and/or the first flow opening and/or the second flow opening is formed in a mirror-symmetrical manner with regard to a main axis of the compressor housing arranged along the rotational axis.

In a further advantageous arrangement of the invention it is provided that the first flow opening and/or the second flow opening are formed in segments and/or elliptical and/or curvilinear and/or sinusoidal and/or with an aperture surface varying over the circumference of the bypass channel. This also represents a constructively simple possibility for generating a defined flow irregularity in the flow region of the compressor wheel.

With an aperture plane of the inflow channel being arranged at an angle with regard to a radial main plain of the compressor housing arranged perpendicular to the rotational axis, a comparatively high asymmetric inflow of the compressor wheel can be generated.

It has thereby been shown to be advantageous if the angle is between 1° and 30°, in particular between 3° and 20°, and preferably between 5° and 10°. A simple adaptability of the inflow behavior to different types of internal combustion engines is given hereby.

Further advantages result in that a channel wall separating the inflow channel and the bypass channel is held at the compressor housing by means of at least one stay. With the help of such a stay, a desired asymmetry effect of the circumferential flow can be caused. This additionally represents a constructively simple possibility to fix the location of the channel wall in the compressor housing.

In a further advantageous arrangement of the invention, several stays are provided which are preferably formed in an asymmetric manner with regard to the rotational axis over the circumference of the channel wall. In this manner, larger circumferential regions can be covered with material in a defined manner, whereby a correspondingly increased degree of asymmetry can be achieved. A mechanically stable support of the channel wall in the compressor housing is achieved with the help of several stays.

A further aspect of the invention relates to a motor vehicle with an internal combustion engine and a radial compressor arranged in an intake section of the internal combustion engine, wherein a decrease of the surge line of the radial compressor in a constructively simple manner and an improved adaptability to the requirements of different types of internal combustion engines is enabled according to the invention in that the radial compressor is formed according to one of the preceding embodiments. The advantages resulting from this can be taken from the corresponding descriptions.

The invention and further advantages, characteristics and details thereof will become more readily apparent from the following description of a particular exemplary embodiment with reference to the accompanying the drawings, in which comparable elements are provided with identical reference numerals.

BRIEF DESCRIPTION OF THE DRAWINGS

FIG. 1 is a schematic lateral cross-sectional view of a radial compressor according to one embodiment.

DESCRIPTION OF EXEMPLARY EMBODIMENTS

FIG. 1 shows a schematic lateral sectional view of a radial compressor according to one embodiment of the invention. The radial compressor, which is in the form of a compressor of an exhaust gas turbocharger, comprises a compressor housing 10, in which a compressor wheel 12 is arranged. With the help of the compressor wheel 12, air from an inflow channel 14 of the compressor housing 10 is compressed and directed into a spiral outflow channel 16 of the compressor housing 10. The compressor wheel 12 is driven in a manner known per se via a turbine wheel (not shown) of a turbine of the exhaust gas turbocharger. The compressor housing 10 additionally comprises an annular bypass channel 18, which has at least a first flow opening 20*a* arranged upstream of an axial compressor wheel inlet 22 to the compressor wheel 12 and a second flow opening 20*b* arranged downstream of the compressor wheel inlet 22. In an operating region near the surge line, it is possible with the KSM performance graph stabilizing feature to discharge air by way of the compressor wheel 12 into the bypass channel 18 through the second flow opening 20*b* and to guide it back into the inflow channel 14 and to the compressor wheel inlet 22 via the first flow opening 20*a*. The mass flow entering the compressor wheel 12 is highly increased in this manner. In order to provide for a lowering of the surge line and an improved adaptability to the requirements of different types of internal combustion engines in a constructively simple manner, the compressor housing 10 is formed so as to be asymmetric manner with regard to a rotational axis D of the compressor wheel in the flow region II-II upstream of the outflow channel 16. Contrary to the state of the art, the bypass channel 18 and an aperture plane 24 of the inflow channel 14 are thereby in particular formed in a rotational asymmetric manner. A corresponding asymmetric inlet flow into the compressor housing 12 is achieved hereby, which effects a significant stabilization of the rotational flow discontinuity in the different flow channels of the compressor housing 10. In this manner, the pumping tendency of the compressor wheel 12 is reduced in a constructively simple and cost-effective manner and displaced to lower mass flow rates. It can thereby be provided that the second flow opening 20*b* is only formed partially or in segments over the circumference of the compressor wheel 12, whereby the asymmetric inflow can be amplified or diminished in a defined manner. It can also be provided that the second flow opening 20*b* is not arranged radially with regard to the rotational axis D or of a main plane $H_r$ extending perpendicularly to the rotational axis. Axial progressions along a main circumferential direction can also be provided, which can possibly be formed curvilinear or sinusoidal. As shown in FIG. 1, the aperture plane 24 is arranged with an angle $\alpha$ of about 8° with regard to the main plane $H_r$ which extends perpendicular to the rotational axis D. It can thereby be provided in principle in that the compressor housing 10 is formed mirror-symmetrical at least in the flow region II-II with regard to an axial main plane $H_a$ extending along the rotational axis D In the shown embodiment, the bypass channel 18 with its inner channel wall 26*a* and its outer channel wall 26*b* has a very high asymmetry with regard to the rotational axis D. The outer channel wall 26*b* is herein virtually symmetrical, whereas the inner channel wall 26*a* shows a high degree of asymmetry with regard to the rotational axis D. The asymmetry can in principle also be generated by an inverse configuration in that the inner channel wall 26*a* proceeds virtually symmetrical to the rotational axis D and the outer Channel wall 26*b* has the desired degree of asymmetry with respect to the rotational axis D. It can also be provided that none of the two channel walls 26*a*, 26*b* has a rotational symmetry. It can further be provided that the two channel walls 26*a*, 26*b* have cylinder casing surfaces displaced with regard to the rotational axis D, elliptical or other surface configurations.

In FIG. 1, two stays 28 are shown, by means of which the channel wall 26 separating the inflow channel 14 and the bypass channel 18 are supported in the compressor housing 10. The stays 28 are arranged distributed around the circumference of the channel wall 26 and are of different radial length to support the channel wall asymmetrically. Alternatively to the relatively low obstructions of the shown stays 28, it can be provided that larger regions are occupied with a material over the circumference, whereby a correspondingly larger asymmetric effect of the circumferential flow can be caused. By means of an optimum asymmetric formation of the compressor housing, a considerable widening of the compressor performance graph can be provided in a constructively simple and cost-efficient manner and in particular a displacement of the surge line to lower mass flow rates can be achieved.

What is claimed is:

1. A radial compressor, particularly for an exhaust gas turbocharger of an internal combustion engine, said radial compressor having a compressor housing (10) with an inflow channel (14), an outflow channel (16), and a compressor wheel (12) disposed within the compressor housing (10) for compressing air inducted from the inflow channel (14) of the compressor housing (10) and for guiding the air into the outflow channel (16) of the compressor housing (10), the compressor housing (10) including a bypass channel (18) having at least a first flow opening (20*a*) upstream of an axial compressor wheel inlet (22) and a second flow opening (20*b*) disposed downstream of the compressor wheel inlet (22), the compressor housing (10) being formed at least in one flow region (II-II) upstream of the outflow channel (16) with radially inner and radially outer channel walls (26*a*, 26*b*) forming an annular bypass channel (18) which is circumferentially asymmetric with regard to a rotational axis (D) of the compressor wheel (12).

2. The radial compressor according to claim 1, wherein at least one of the radially inner and the radially outer channel walls (26*a*, 26*b*) of the bypass channel (18) is elliptical in its cross section over a longitudinal area.

3. The radial compressor according to claim 1, wherein at least one of the bypass channel (18), the inflow channel (14), the first flow opening (20*a*) and the second flow opening (20*b*) is formed in a mirror-symmetrical manner with regard to an axial main plane ($H_a$) of the compressor housing (10) extending along the rotational axis (D).

4. The radial compressor according to claim 1, wherein at least one of the first flow opening (20*a*) and the second flow opening (20*b*) is formed in segments and in one of an elliptical, curvilinear and sinusoidal form and with an aperture flow cross section varying over the circumference of the bypass channel (18).

5. The radial compressor according to claim 1, wherein an aperture plane (24) of the inflow channel (14) is arranged at an angle ($\alpha$) with regard to a radial main plane ($H_r$) of the compressor housing (10) which extends perpendicular to the rotational axis (D).

6. The radial compressor according to claim 5, wherein the angle ($\alpha$) is between 1° and 30°.

7. The radial compressor according to claim 1, wherein a channel wall (26) separating the inflow channel (14) and the bypass channel (18) is supported in the compressor housing (10) by means of at least one stay (28).

8. The radial compressor according to claim 7, wherein several stays (28) are provided, which are arranged asymmetrically around the circumference of the channel wall (26) with regard to the rotational axis (D).

9. A motor vehicle with an internal combustion engine including an exhaust gas turbocharger having a radial compressor arranged in an intake section of the internal combustion engine, said radial compressor having a compressor housing (10) with an inflow channel (14), an outflow channel (16), and a compressor wheel (12) disposed within the compressor housing (10) for compressing air inducted from an inflow channel (14) of the compressor housing (10) and for guiding the air into the outflow channel (16) of the compressor housing (10), the compressor housing (10) including a bypass channel (18) having at least a first flow opening (20*a*) upstream of an axial compressor wheel inlet (22) and a second flow opening (20*b*) disposed downstream of the compressor wheel inlet (22), the compressor housing (10) being at least in one flow region (II-II) upstream of the outflow channel (16) asymmetric with regard to a rotational axis (D) of the compressor wheel (12) in that radially inner and radially outer channel walls (26*a*, 26*b*) form an annular bypass channel (18) which is formed circumferentially asymmetric with respect to the rotational axis (D) of the compressor wheel (12).

* * * * *